United States Patent [19]

Stange

[11] 4,427,285

[45] Jan. 24, 1984

[54] DIRECT DUPLEX PRINTING ON PRE-CUT COPY SHEETS

[75] Inventor: Klaus K. Stange, Pittsford, N.Y.

[73] Assignee: Xerox Corporation, Stamford, Conn.

[21] Appl. No.: 239,094

[22] Filed: Feb. 27, 1981

[51] Int. Cl.[3] ..... G03G 15/00

[52] U.S. Cl. ..... 355/3 FU; 355/3 R; 355/14 FU; 355/14 R; 355/24

[58] Field of Search ..... 355/3 FU, 14 FU, 24, 355/3 R, 14 R

[56] References Cited

U.S. PATENT DOCUMENTS

| | | | |
|---|---|---|---|
| 3,900,590 | 8/1975 | Dhoble | 355/3 F UX |
| 3,944,360 | 3/1976 | Deetz et al. | 355/24 X |
| 4,059,394 | 11/1977 | Ariyama et al. | 355/3 F UX |
| 4,116,558 | 9/1978 | Adamek et al. | 355/24 |
| 4,218,499 | 8/1980 | Shinohara et al. | 355/3 F UX |

*Primary Examiner*—A. C. Prescott

*Attorney, Agent, or Firm*—Ronald F. Chapuran

[57] ABSTRACT

The present invention is a two photoreceptor, single pass duplex reproduction system having a heat insulating prefuser transport device and first and second transfer stations. In particular, the prefuser transport is a pair of cold, toner compacting rolls adjacent the second transfer station for immediate pick up of a copy sheet supporting unfused images on both sides. The compacting rolls tack the unfused images to the copy sheet. The compacting rolls also insulate the photoreceptor from the heat of the fuser and convey the copy sheet immediately to the fuser. The fuser permanently fixes the images onto the copy sheet in one fuser operation. In a preferred embodiment, the fuser rolls operate at a slightly lower peripheral velocity than the compacting rolls. Also, because of the tacking of the image by the cold rolls, the fuser rolls operate at a relatively lower temperature or pressure than normally.

16 Claims, 1 Drawing Figure

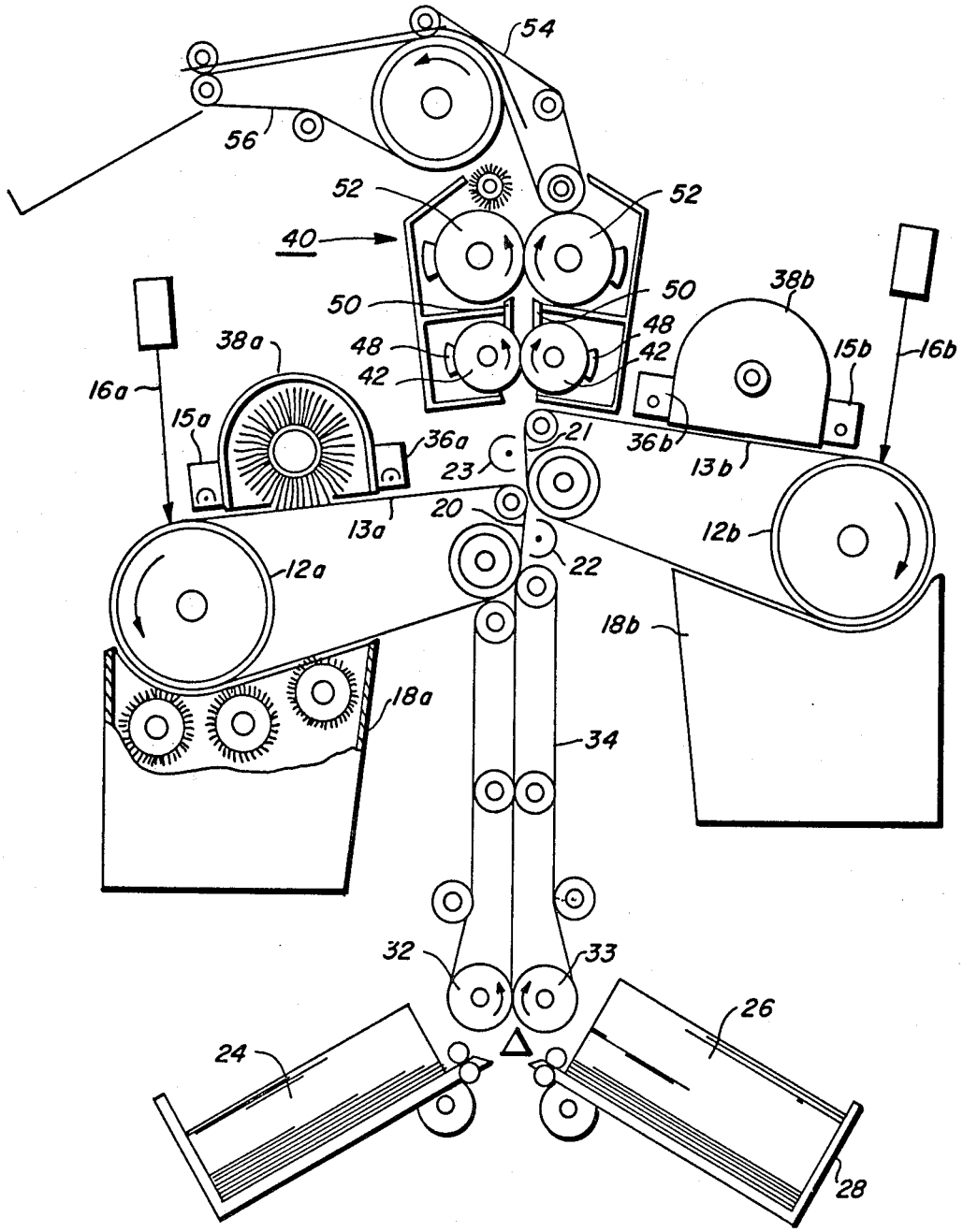
54
56
52
52
40
50
50
48
48
42
42
38b
38a
15b
16b
16a
15a
36a
21
36b
23
13b
20
13a
12b
22
12a
18b
18a
34
32
33
26
24
28

DIRECT DUPLEX PRINTING ON PRE-CUT COPY SHEETS

BACKGROUND OF THE INVENTION

Many methods for automatic duplex printing in xerographic processors have been devised. There is the classical two pass method employed in the Xerox 4000 and 9400 reproduction machines. That is, after the first side of a copy sheet is imaged and fused, the sheets are collected in a duplex tray. After the last sheet in a set has been received in the duplex tray, the sheets are again passed through the processor. This time an image is transferred and fused onto the opposite side of each copy sheet having an image on a first side.

In the Xerox 9700 machine, the copy sheets also pass through the processor twice. However, they are not collected in a duplex tray. After the first image has been transferred and fused, the sheets pass through a stop and reverse mechanism (inverter). Then the sheets join in an interleafing fashion the stream of copy sheets to receive an image on the opposite side.

There are some disadvantages with these systems, in particular for a given image throughput rate. For example, two passes through the fuser require more energy, and the fuser needs to operate at twice the speed. During the first pass through the fuser, the paper loses 50 percent of its moisture. This curls the paper (especially thick stock) and makes the second pass for duplexing hazardous. Paper picks up oil on the first pass through the fuser, sometimes leading to image deletions on the second image and oil deposits on the photoreceptor. Jam rates during two-pass duplex operation are much greater than for simplex operation. In the first place, in a two-pass duplex system, the paper path is usually very long, and the paper has to negotiate all obstacles twice. Excessive paper curl is not only troublesome in the processor but also extremely difficult to handle in output stackers and finishing devices.

In other prior art systems such as in U.S. Pat. No. 4,095,979, means are shown for "immediate" or single pass duplex copying of forming first and second images sequentially on a photoreceptor. The first image is transferred from the photoreceptor to the first side of a copy sheet. Then the sheet is stripped off the photoreceptor, inverted while the first image remains unfixed, and then the second image is transferred to the second side of the copy sheet. Both images are then fixed onto the copy sheet in a suitable fuser. This type of system can be described as a "single pass" to the fuser.

Other single pass duplex printing methods use intermediate image carriers (belt or drum). The first and second images are sequentially formed on a photoreceptor. The first image is transferred to an intermediate image carrier. The copy sheet is then passed between the photoreceptor and the intermediate iamge carrier, simultaneously receiving first and second images.

One of the problems with the prior art or single pass duplex systems is in conveying the duplex copy sheet to the fuser. In particular, the copy sheet with the two unfused images on opposite sides, must be transported from its second stripping point (after the second side transfer) into the fuser. This cannot be done with a conventional photoreceptor fuser transport since the transport would contact one of the sides of the copy sheet and smeär one unfused toner image. Also, to avoid the lead edge of the sheet from dropping in the path between transfer and fuser must be very short, and the fuser must be very close to the photoreceptor. This creates problems in mechanical mounting, problems of heating of the photoreceptor and problems of contamination of the photoreceptor with fuser release materials, e.g. silicone oil vapor.

In addition there is the problem of the uncontrollable velocities of sheets passing through roll fusers. There is an obvious need to accurately match the velocity of the copy sheet transport with the velocities of the photoreceptor to prevent "skips" and "smears" during transfer. Furthermore, for high resolution digital printing, excessive instantaneous photoreceptor velocity variations (jitter) cannot be tolerated. Fuser rolls are notorious for creating such variations. Even in conventional copiers it is preferable to keep the fuser rolls one sheet length away from the transfer zone. For these reasons it is therefore desirable to thermally insulate and mechnically isolate the photoreceptor transfer zones from the hot fuser rolls.

The duplex methods above only utilize one photoreceptor. Other systems, e.g. U.S. Pat. No. 3,580,070 and 3,775,102 deal with "single pass duplex" methods employing two photoreceptors and two exposure systems. First images are deposited on one photoreceptor and second images are deposited on the other photoreceptor. These systems are considered the ultimate duplex throughput systems since they produce twice the number of images of "two pass duplex" systems at equal process speed. These single pass duplex systems, however, generally require web paper feed in which the copy is spooled up on a roll or cut into individual sheets after fusing. This unfortunately, introduces additional components and complexity into the system. It is, therefore, also desirable to provide a single pass duplex system having a discrete copy sheet feed system rather than a web paper feed system.

It is therefore an object of the present invention to provide a paper handling system adapted to transport cut sheets of a variety of dimensions through a dual photoreceptor processor for direct duplex printing.

It is a further object to provide a two photoreceptor, single pass duplex system having a relatively short paper path between the fuser and the second transfer station.

Still another object of the present invention is to provide a prefuser copy tansport device acting as a heat shield between the fuser and the photoreceptor.

Further advantages of the present invention will become apparent as the following description proceeds, and the features characterizing the invention will be pointed out with particularity in the claims annexed to and forming a part of this specification.

Briefly, the present invention is concerned with a two photoreceptor, single pass duplex reproduction system having a heat insulating prefuser transport device and first and second transfer stations. The prefuser transport device is disposed between the fuser and the transfer stations. In particular, the prefuser transport is a pair of cold, toner compacting rolls adjacent the second transfer station for immediate pick up of a copy sheet supporting unfused images on both sides. The compacting rolls tack the unfused images to the copy sheet. The compacting rolls also insulate the photoreceptor from the heat of the fuser and convey the copy sheet immediately to the fuser. The fuser permanently fixes the images onto the copy sheet in one fuser operation. In a preferred embodiment, the fuser rolls operate at a slightly lower peripheral velocity than the compacting rolls. Also, because of the tacking of the image by the cold rolls, the fuser rolls may operate at a relatively lower temperature or pressure than normally.

Other objects and advantages of the present invention become apparent upon reading the following detailed description and upon reference to the drawing which is a schematic side view of the copy sheet conveying apparatus in accordance with the present invention.

Referring now to the drawing, there is shown schematically in embodiment of the invention in a suitable environment such as a xerographic machine. Portions of the machine are duplicate xerographic processes. In particular, there is shown a pair of photoreceptor belts subsystems including belt drive rolls 12*a* and 12*b* for advancing belts 13*a* and 13*b* through various xerographic processing stations. At charging corotrons 15*a* and 15*b*, a uniform electrostatic charge is deposited on the respective photoreceptor belts 13*a* and 13*b*.

At image paths 16*a* and 16*b*, an image is projected onto the belts 13*a* and 13*b*. Image projection can be through a system of optical components such as lenses and mirrors in the normal electrophotographic exposure method or through some other technology such as pin arrays, print heads or laser output markers. After image projection, the belts 13*a* and 13*b* rotate in the direction of the arrows to the developers 18*a* and 18*b*. At the developers 18*a* and 18*b*, developing material including toner particles is brushed or cascaded over the belt surface in order for the toner particles to adhere to the latent electrostatic image to form a visible toner image of the image to be reproduced.

Belt 13*a* then rotates to transfer station 20 and belt 13*b* rotates to transfer station 21 for electrostatically transferring toner images from the belts 13*a* and 13*b*, respectively, to a transfer material or copy sheet. Transfer and detack corotrons 22 are illustrated at transfer station 20 and transfer and detack corotrons 23 are illustrated at transfer station 21.

In a preferred embodiment, however, it should be noted that detack corotrons will not be required. There should be "self-stripping" of copy sheets from the belts 13*a* and 13*b* for papers as light as 16–18 lbs. even under low humidity conditions and with no toner at the lead edges. In the event that detack corotrons are needed, they can be accommodated.

Copy sheet supply stations 24 and 26, each containing a stack of copy sheets are provided to supply copy sheets of a predetermined size. A movable paper shelf 28 is adjusted to the appropriate copy sheet paper size. The copy sheets are delivered one at a time to the nip of the pretransfer rolls 32, 33 to be conveyed by the pretransfer paper transport 34 to the transfer stations 20 and 21. After transfer of an image to a copy sheet, the belts 13*a* and 13*b* continue rotation to the preclean corotrons 36*a* and 36*b* and cleaning stations 38*a* and 38*b* at which the belt is brushed to remove residual toner particles remaining after image transfer.

In accordance with the present invention, there is provided a fuser station 40 to simultaneously fix images to both sides of the copy sheet. In particular, a first image is transferred to one side of the copy sheet at transfer station 20. After transfer of the first image, the copy sheet self-strips from the photoreceptor belt 13*a*. The copy sheet immediately enters the tranfer zone of photoreceptor belt 13*b* and a second image is transferred to the second side of the copy sheet at transfer station 21. The copy sheet self-strips from belt 13*b*. This is the most critical area of the copy sheet path since the copy sheet cannot be delivered immediately to the fuser rolls for fusing.

In accordance with the present invention, therefore, immediately after the transfer station 21, the copy sheet is conveyed into the nip of two cold, toner compacting rolls 42. Preferably, the rolls are steel, adiabatic (not adding or subtracting heat by design) pressure rolls and can be positioned close to the photoreceptor belt 13*b*. This allows the shortening of the free beam of the lead edge of the copy sheet down to 2 inches in length. The free beam of the lead edge of a copy sheet is the distance from the nip of the compacting rolls 42 to the photoreceptor belt 13*b*. It should be noted eighteen pound paper will have no trouble spanning such a distance. Preferably, (not shown) outboard flanges on the compacting rolls will keep the rolls 42 apart by 1 to 2 mils in the image area. The compacting rolls 42 can be operated at a reduced pressure since the rolls are not intended for fixing of the image. Compacting rolls 42 transport the paper at constant velocity away from the transfer station 21 and compact and tack the toner onto the paper. Preferably this will be accomplished with a pressure which will not calender the paper. It should also be noted that the peripheral velocities of steel rolls can be accurately controlled.

To prevent toner offsetting onto rolls 42, wipers 48 deposit a thin film of release agent onto the rolls 42 while wiping them. A small amount of this release agent will offset onto the paper and image which will help during the actual fusing operation. The paper emerging from rolls 42 is stripped by fingers 50. In a preferred embodiment, a bias voltage between the two rolls 42 is provided to prevent image degradation due to air breakdown at the roll exit.

The paper with the tacked toner images enters the nip of heated soft fuser rolls 52. In accordance with the present invention, the fuser rolls 52 operate at slightly lower peripheral velocity than compacting rolls 42 to prevent any erratic velocity feedback to rolls 42. It should be noted that it will generally be easier for the fuser to fix the toner since the toner already is compressed into the paper. This will allow the operation of the fuser rolls 52 at either lower temperature or pressure, and with a shorter nip length. The rolls 42 are cold rolls disposed between the belt 13*b* and the fuser rolls 52 providing both mechanical separation and a heat shield between the belt and fuser rolls 52.

It should also be noted that roll fusers contribute about 10 percent of all on-site service cost with heavy emphasis on parts cost. Roll fuser degradation is largely related to heat and deformation stresses in the surface coatings. In a single pass duplex systems, the fuser only operates at one-half the speed to create an equal image throughput. Even a 15° reduction in fuser temperature will help to improve roll life, and fuser oil will not be as readily evaporated. Also a high temperature fuser will evaporate print solvents which could settle in the printer or could be exhausted into the room.

After fixing the toner images to the copy sheet by fuser rolls 52, the copy sheet exits the fuser station 40. It is then conveyed by suitable transports 54 and 56 to a not shown tray or bin.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. In a reproduction machine for producing impressions of an original, the reproduction machine having a station for supplying discrete copy sheets, and a plurality of operating components cooperable with one another to produce the impressions on a copy sheet, the operating components including:

a first photosensitive member, a first transfer station for transferring an image from the first photosensitive member onto a first side of a copy sheet, a second photosensitive member, a second transfer station for transferring an image from the second photosensitive member onto the opposite side of the copy sheet, and a fuser station including, fixing means having heated fuser rolls, and compacting rolls disposed between the fixing means and the second transfer station, the fuser rolls operating at a lower peripheral velocity than the compacting rolls, the compacting rolls insulating the photosensitive member from the fuser station whereby the toner images are simultaneously tacked to each side of the copy sheet and conveyed to the fixing means.

2. The machine of claim 1 wherein the compacting rolls are adiabatic pressure rolls.

3. The machine of claim 1 wherein the compacting rolls are disposed near the second photosensitive member whereby the free beam of the lead edge of a copy sheet at the photosensitive member is less than 6 inches from the nip of the compacting rolls.

4. The machine of claim 1 wherein the compacting rolls are steel and have outboard flanges whereby the rolls are spaced apart at least one mil at the image area on the copy sheet.

5. The machine of claim 1 wherein the compacting rolls transport copy sheets at a constant velocity away from the second transfer station and tack toner images onto the copy sheet.

6. The machine of claim 1 wherein the fuser rolls operate at a relatively lower temperature or pressure and have a shorter nip length.

7. The apparatus of claim 1 wherein the fixing means is a flash fusing device.

8. In a xerographic reproducing machine having photosensitive means and wherein discrete copy sheets are fed from a copy sheet supply station along a path to a fusing station, a transfer means located along the path between the copy sheet supply station and the fusing station whereat toner images are transferred to the copy sheet on both sides of the copy sheet, said fusing station including a heat applying device and a heat shield, the heat shield disposed between the transfer means and the heat applying device to insulate the heat applying device from the photosensitive means and to provide initial tackdown of the unfused images onto the copy sheets.

9. In a xerographic machine having a photoreceptor and wherein toner images are electrostatically held to both sides of a discrete copy sheet, fusing means including, a heat source located along the path of the copy sheet to simultaneously fix the toner images to both sides of the copy sheet moved therepast and, a transport mechanism located adjacent the photoreceptor in advance of the heat source whereby the transport mechanism conveys the copy sheet having toner images on both sides to the heat source for fusing, the transport mechanism thermally isolating the photoreceptor from the heat source.

10. In a reproduction machine for producing impressions of an original, the reproduction machine having a photosensitive component, a station for supplying discrete copy sheets, a plurality of operating components including a transfer station to tranfer the image from the photosensitive component to a copy sheet, the operating components being cooperable with one another to produce the impressions on the copy sheet, and a fusing station for fixing the impressions on the copy sheet wherein the improvement comprises a heat shield at the fuser station disposed adjacent the transfer station, the heat shield having pressure rolls to transport the copy sheets away from the transfer station whereby images are simultaneously tacked to each side of the copy sheet before fixing.

11. The machine of claim 10 wherein the fusing station includes a heated soft roll fuser operating at a slightly lower peripheral velocity than the pressure rolls.

12. The machine of claim 10 wherein the photosensitive component includes a first photosensitive member and a second photosensitive member and the transfer station includes a first transfer member for transferring an image from the first photosensitive member onto a first side of a copy sheet and a second transfer member for transferring another image from the second photosensitive member onto the other side of the copy sheet.

13. The machine of claim 12 wherein the heat shield is disposed adjacent the second transfer member.

14. The machine of claim 13 wherein the heat shield, is disposed intermediate the second transfer member and the heat source.

15. The machine of claim 14 wherein the heat source is a soft roll fuser and the heat shield is a pair of pressure rolls.

16. The machine of claim 15 wherein the pressure rolls are disposed near the second photosensitive member whereby the free beam of the lead edge of a copy sheet at the second photosensitive member is less than six inches from the nip of the pressure rolls.

* * * * *